United States Patent [19]

Egbers et al.

[11] 4,452,053

[45] Jun. 5, 1984

[54] STAMPED KNITTING-TOOL FOR KNITTING MACHINES

[75] Inventors: Gerhard Egbers, Reutlingen; Bernhard Schuler, Sonnenbühl-Erpfingen; Adolf Seidel; Günter Bühler, both of Reutlingen, all of Fed. Rep. of Germany

[73] Assignee: Sulzer Morat GmbH, Fed. Rep. of Germany

[21] Appl. No.: 291,934

[22] Filed: Aug. 11, 1981

Related U.S. Application Data

[63] Continuation of Ser. No. 38,316, May 11, 1979.

[30] Foreign Application Priority Data

May 12, 1978 [DE] Fed. Rep. of Germany ..... 2820925

[51] Int. Cl.[3] ..... D04B 35/02

[52] U.S. Cl. ..... 66/123

[58] Field of Search ..... 66/116, 121, 123, 120

[56] References Cited

U.S. PATENT DOCUMENTS

| | | | |
|---|---|---|---|
| 3,464,237 | 9/1969 | Kohorn | 66/121 |
| 3,712,082 | 1/1973 | Kohorn | 66/127 |
| 3,874,199 | 4/1975 | Mayer et al. . | |
| 3,994,145 | 11/1976 | Stolz | 66/121 X |
| 4,068,500 | 1/1978 | Kohorn | 66/123 |
| 4,089,192 | 5/1978 | Kohorn | 66/123 |

FOREIGN PATENT DOCUMENTS

| | | | |
|---|---|---|---|
| 2408567 | 9/1975 | Fed. Rep. of Germany | 66/123 |
| 39-19263 | 7/1964 | Japan | 66/123 |
| 49-43152 | 11/1974 | Japan | 66/123 |

OTHER PUBLICATIONS

Torrington "Latch Needle Handbook", Torrington Co., 1971, Torrington, Conn., pp. 8, 60, 61.

*Primary Examiner*—Ronald Feldbaum

[57] ABSTRACT

A pivoted latch needly having stem segments or budge portions of a height of eleven tenths of a millimeter and a length of at least eight millimeters.

17 Claims, 6 Drawing Figures

STAMPED KNITTING-TOOL FOR KNITTING MACHINES

This is a continuation, of application Ser. No. 038,316, filed May 11, 1979.

The invention refers to a stamped knitting-tool which can be employed in knitting machines and has a head bent like a hook, a shaft having at least one bridge which consists of two guidepieces extending as far as the back of the knitting-needle and a stem arranged above the back to bridge across the guidepieces, and at least one butt coupled to the shaft in the region of the bridge, where the stem includes at least one first segment arranged between the head and the butt.

Stamped knitting-tools of this kind are in particular latch needles (West German O/S No. 24 08 567), needles or components which indeed exhibit an end bent like a hook, i.e., the so-called head, but no latches, e.g., plus hooks for the formation of plush loops (West German Pat. No. 18 16 864), or parts carrying hooks, of tubular (compound) on pusher needles (West German O/S No. 25 37 502). All of these knitting-tools lie with their backs on the bottoms of tricks each formed in the needle bed of a knitting machine and during the knitting process are moved to and fro at high speed and acceleration by means of cams which act upon their butts.

With increasing knitting speed head breakages occur on the said knitting-tools ever more frequently, which severely limit the knitting speed. Circular knitting machines of large diameter, which have a rotatable needle cylinder of a diameter of about 76.2 cm (30 inches) can as a rule, be operated at speeds of rotation of the cylinder of at most 28 revolutions per minute. Above these rotational speeds head breakages occur so frequently that the standstill times of the machine, necessary for repair of the head breakages, are no longer justifiable.

For avoidance or respectively reduction of head breakages there are essentially two possibilities. The one possibility consists in making the cams in such a way that the butts of the knitting-tools strike them as gently as possible and do not get subjected to any abrupt alterations in speed. By measures of that kind no considerable increase in output in knitting could hitherto be achieved because these measures can be realized only with relatively long cams, which oppose any increase in output.

The other possibility, namely, of providing the knitting-tools with a means which avoids head breakages or lets them start to an extent worth mentioning only at higher knitting speeds, has apart from an efficacy which is too slight proved too costly and technically too complicated. Known means of this kind consist, for example, either of making the shafts of the knitting-tools in such a way that they comprise shock-absorbing intermediate members (West German O/S No. 26 10 078), damping zones in the form of indentations or of a differing mechanical structure (West German A/S No. 16 35 837), corrugations running in the direction of the width of the shaft (West German A/S No. 22 39 196) or the height of the shaft (West German Utility Model 75 02 317), sections twisted like a propellor (West German O/S No. 21 57 404) or offset sections (West German O/S Nos. 22 57 847 and 24 08 567) in the form of bridges, or of providing the knitting-tools with butts which are slit, continue into the shaft in the region of indentations and exhibit on the back likewise indentations (West German A/S No. 22 29 858) or are coated with shock-absorbing materials (West German O/S No. 23 04 727). Finally knitting-tools are known, too, which consist of a stamped section carrying the butt and a section of wire carrying the head, these two sections being welded together along their longitudinal edges (West German O/S No. 23 30 474).

Since none of the proposals indicated above has hitherto led to satisfactory and in particular adequately reproducible increases in knitting speed, it is an object of the invention to improve the knitting-tool designated above by simple means and in a reproducible manner. Another object of the invention is to provide a needle of the above kind, wherein under comparable conditions may be moved to and fro at considerably higher speeds and accelerations without the number of head breakages during the test period altering worth mentioning.

For the solution of the problem the invention is characterized in that said first segment has over a length of at least eight millimeters (8 mm) a height of at most eleven tenths of a millimeter (1.1 mm).

The combination of a knitting-tool of the kind designated above with a stem which has a relatively long and extremely small first segment leads surprisingly to a very effective reduction in the number of head breakages observed in a test period or respectively to a considerably increased life of the knitting-tool under comparable conditions. This result is the more surprising that it seems to be totally independent of the form of the knitting-tool employed in the particular case and arises even in the case of those knitting-tools of the kind designated above, which are provided in addition with one of the above-mentioned known means for reduction of head breakages. Even if there are already or should already have been knitting-tools having stem segments or portions the height of which is equal to or less than thirteen tenths of a millimeter (1.3 mm), it would be a purely fortuitous result because hitherto in the technical world the knowledge was lacking that the height of the stem in the case of stamped knitting-tools of the designated species has a causal connection with the occurrence of head breakages and the frequency of head breakages is the lower, the smaller the height of the stem and the longer the section of the stem which has been made low.

Latch needles which have been provided with the means in accordance with the invention for the avoidance of head breakages have been subjected on circular knitting machines of large diameter to endurance tests at rotational speeds of the needle cylinder of at least thirty revolutions per minute. The continuous operation ran free of problems without head breakages worth mentioning. The possible raising of the rotational speed of the needle cylinder amounted in comparison with endurance tests with corresponding known latch needles to at least twenty percent.

The technical success achieved with the invention is attributed to the butt of the knitting-tool in accordance with the invention being coupled by a very easily bendable neck to the shaft, so that the whole knitting-tool can vibrate in a strongly damped manner or respectively the impact energy exerted on the butt can be converted into bending work.

Tests hitherto have shown that the desired reduction in the number of head breakages with the reduction of the height of the stem from usually thirteen tenths of a millimeter (1.3 mm) and over starts recognizably at eleven tenths of a millimeter (1.1 mm) and upon reaching a height of the stem of ninth tenths of a millimeter (0.9 mm) leads to increases in knitting speed by more than twenty percent. By further reduction of the height of the stem the knitting speed can be raised still further. As regards the length of the narrowed section of stem considerable improvements appear already from about eight millimeters in comparison with corresponding known knitting-tools and with greater length of this section they become still more striking.

Further advantages of the invention are to be seen in the fact that for the achievement of the success being striven for, no costly manipulations of the knitting-tool are necessary, but merely correspondingly dimensioned stamping tools are needed, and that the knitting-tools in accordance with the invention are considerably lighter than comparable known knitting-tools and therefore at the same trick clearance can be moved to and fro considerably more easily. By this means the driving power needed in the knitting process is reduced by about twenty-five percent, a noticeable reduction in the temperature of the knitting machine in continuous operation is achieved and the occurrence of needle lines in the knitting is avoided.

Further advantageous features of the invention follow from the Sub-Claims.

The invention is explained in greater detail below in embodiments which are illustrated in the attached FIGS. 1 to 6 which show in each case side elevations of latch needles. Like parts are moreover provided throughout with the same reference numbers.

Figure 1:
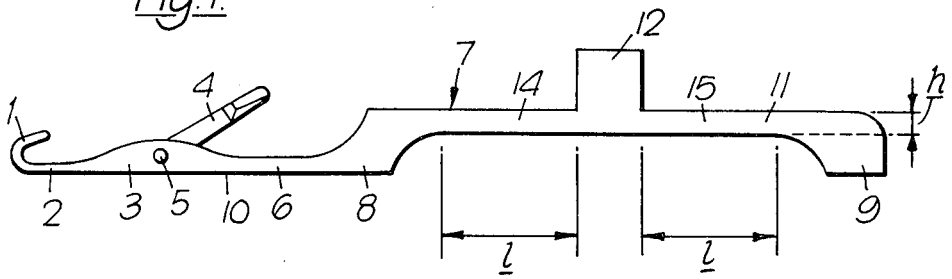
FIG. 1 is a pivoted latch needly illustrating a bridge with two guide pieces the bottom ends of which lie with the back of the needle, a butt with two segments on either side thereof.

The needle illustrated in FIG. 1 and known, for example, from West German O/S 24 08 657, is a stamped latch needle having an exposed head 1 bent like a hook, a neck 2, a breast 3 in which a latch 4 is supported pivotally by means of a pin 5, a throat 6 and a shaft adjoining it, which exhibits a bridge 7. The bridge 7 consists on the one hand of two guidepieces 8 and 9 the bottom ends of which lie in one line with the back 10 of the needle, which during the knitting process rests upon the bottom of a trick formed in a needle bed of a knitting machine, and on the other hand of a stem 11 arranged above the back 10 of the needle to bridge across the two guidepieces 8 and 9. A butt 12 is coupled to the shaft in the region of the bridge 7 in such a way that it borders directly on a central part of the stem 11, so that the latter has a first segment 14 arranged between the head 1 and the butt 12 and a second segment 15 lying at the side of the butt 12 remote from the head 1. The two segments 14 and 15 have in accordance with the invention a length l of at least eight millimeters each and a height h of at most eleven tenths of a millimeter and directly adjoin the butt 12, so that the latter is coupled in a supple manner to the shaft. The ends of the segments 14 and 15 remote from the butt 12 widen out gradually in the direction of the guidepieces 8 and 9 to which they are connected.

Figure 2:
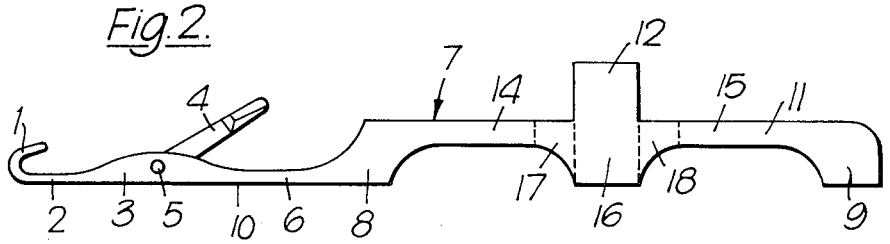
FIG. 2 is another embodiment of the invention.

The embodiment as FIG. 2 is distinguished from the embodiment as FIG. 1 only in that the bridge 7 includes a further guidepiece 16 which extends as far as the back 10 of the needle and is arranged directly below the butt 12 associated with the bridge 7. Furthermore the segments 14 and 15 do not as with the needle as FIG. 1 border on the butt 12 directly but via parts 17 and 18 of the stem which are indicated by dotted lines and exhibit a greater height than the segments 14 and 15. Although the best results are achieved with the needle as FIG. 1, in which the parts 17 and 18 of the stem likewise exhibit a height of at most eleven tenths of a millimeter, the butt is coupled in an adequately supple manner to the shaft even when the parts 17 and 18 of the stem are somewhat higher, e.g., fifteen or twenty tenths of a millimeter high. The results achieved are however better, the smaller and the longer the parts 17 and 18 of the stem. The length of the parts 17 and 18 of the stem, measured in the direction longitudinal to the needle, should not be greater than about five millimeters.

Figure 3:
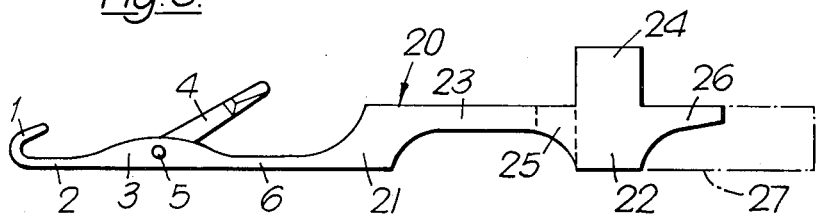
FIG. 3 is a further embodiment of the invention.

In the case of the needle as FIG. 3 the shaft exhibits a bridge 20 which is formed by two guidepieces 21 and 22 and a stem 23 connecting them. But in distinction from FIGS. 1 and 2 the whole stem 23 is arranged between the head 1 and a butt 24 associated with the bridge 20, where the butt 24 borders from above on the guidepiece 22 lying further removed from the head 1. The stem 23 in a central first segment at least eight millimeters long is not higher than eleven tenths of a millimeter, has at both ends of this central neck an increasing height and borders by means of a part 25 of the stem, indicated by dotted lines, on the butt 24 which is higher than eleven tenths of a millimeter. For the rest the same holds for the dimensions of the part 25 of the stem as for the parts 17 and 18 of the stem of the needle as in FIG. 2.

The part 26 of the shaft, lying behind the butt 24, has in the case of the needle as FIG. 3 no significance but could, for example, be provided with a recess for reception of the coupling part of a jack or as in the case of an ordinary needle be made as an afterguide as indicated by the dotted line 27.

Figure 4:
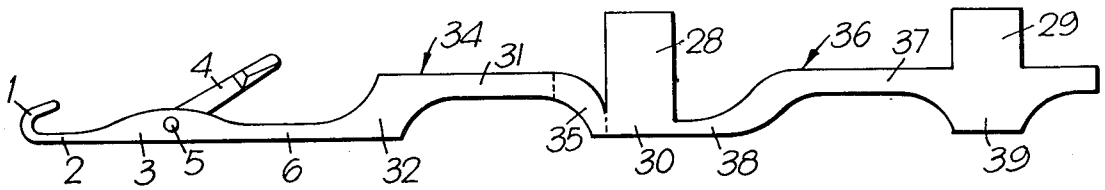
FIG. 4 is a further embodiment of the invention.

The needle as FIG. 4 differs essentially from the needles described hitherto, firstly in that it has two butts 28 and 29. Moreover a guidepiece 30 is provided underneath the butt 28, which forms together with a stem 31 lying between the butt 28 and the head 1 and a guidepiece 32 lying between the head 1 and the stem 31 a bridge 34 associated with the butt 28. In contrast with FIGS. 1 to 3 the one end of the stem 31 does not border on the butt 28 but on the guidepiece 30 via a part 35 of the stem, indicated by dotted lines. For the rest the stem 31 has the same dimensions as, for example, the stem 23, whilst the part 35 of the stem may exhibit the same dimensions as the parts 17, 18 and 25 of the stem or be continuously smaller than eleven tenths of a millimeter.

A further butt 29 is arranged in the region of a further bridge 36 the stem 37 of which has at least one portion which lies between the two butts 28 and 29 and has over a length of at least eight millimeters a height of at most eleven tenths of a millimeter. The bridge 36 is formed by the stem 37 and two guidepieces 38 and 39, the whole stem 37 being arranged between the two butts 28 and 29. Alternatively the butt 29 might also be arranged in the region of a bridge as FIG. 1, in which case the front section of stem provided with the reference number 14 could adjoin the butt 28 directly.

In the absence of the butt 29 the needle as FIG. 4 has a shape similar to the needle as FIG. 1. A difference follows from the fact that for this case the part 38 on the one hand acts as a prolongation of the guidepiece 30 but on the other hand it may be conceived as a prolongation of the stem 37 or as a part of the stem which has a similar function to the part 35 of the stem. Consequently the guidepiece 38 may exhibit too the same dimensions as the part 35 of the stem and in particular be higher than eleven tenths of a millimeter.

Figure 5:
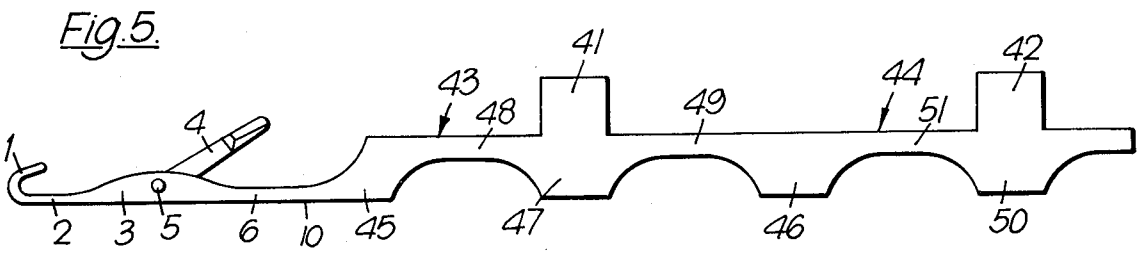
FIG. 5 is another embodiment of the invention.

The embodiment as FIG. 5 exhibits two butts 41 and 42 which are arranged in the region of two bridges 43 and 44. The bridge 43 lying nearer the head 1 is made to correspond with FIG. 2 and exhibits two guidepieces 45 and 46 as well as a further guidepiece 47 lying under the butt 41, between which extend the two segments 48 and 49 of a stem, which exhibit the same dimensions as the segments 14 and 15 as FIG. 2. The other bridge 44 consists of the guidepiece 46, a guidepiece 50 arranged underneath the butt 42 and a stem 51 extending between these two so that the bridge 44 associated with the butt 42 is made to correspond with the bridge 20 as FIG. 3 and consequently the stem 51 has the same dimensions as the stem 23 as FIG. 3.

Figure 6:
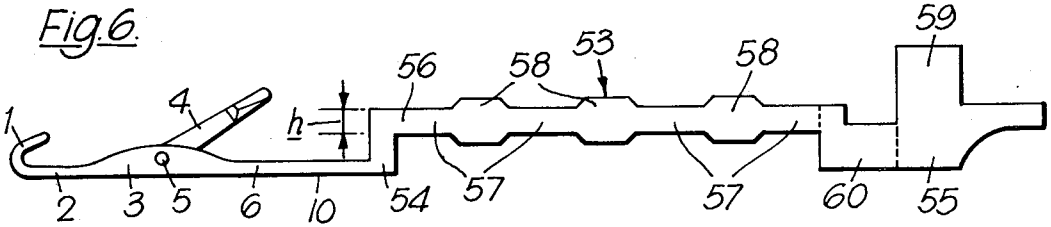
FIG. 6 is another embodiments of the invention.

The shaft of the needle as FIG. 6 includes a bridge 53 which consists of two guidepieces 54 and 55 and a stem 56 bridging across them. The stem 56 exhibits a number of parts 57 having a height h of at most eleven tenths of a millimeter and a number of parts 58 lying between them having a greater height. The length measured in the direction axial to the needle of the individual parts 57 is moreover big enough for the total length of all of the parts 57 of a height of at most eleven tenths of a millimeter to amount to at least eight millimeters.

A butt 59 of the needle as FIG. 6 borders directly on the guidepiece 55 which is coupled via a part 60 of the stem to the stem 56 or respectively to one part 57 of it. Hence in the case of this embodiment too the butt 59 is not coupled directly to a portion of a stem which is smaller than eleven tenths of a millimeter, since the supple coupling of the butt 59 to the shaft is possible even with the interposition of the guidepiece 55 and the part 60 of the stem as long as the part 60 of the stem is not too high and not too long. The part 60 of the stem for the rest acts simultaneously as a prolongation of the guidepiece 55.

In the case of needles or other knitting-tools which exhibit no neck 2, no breast 3, no latch 4 and/or no throat 6 one must proceed in a corresponding way. In that case it is to be observed that the throat 6 which usually exists in the case of latch needles and frequently has a height of less than eleven tenths of a millimeter and may be formed in the upper region of the needle or else in the back of it, forms no part of the invention. As compared with the known throat 6 the invention is on the contrary to be seen in the fact that at least one butt of the knitting-tool is by means of a bridge which exhibits a stem arranged above the back of the knitting-tool and provided with certain minimum and maximum measurements, coupled to the shaft in such a supple manner that the number of head breakages normally observed at a certain knitting speed in comparison with the same knitting-tool without supple coupling of the butt is lower.

The invention is for the rest not restricted to the described embodiments. In particular the individual features described in the described embodiments may be combined in manifold ways.

The knitting-tools in accordance with the invention are particularly suitable for flatbed knitting machines as well as for circular knitting machines of large diameter having rotatable cam rings and stationary needle cylinders or having rotatable needle cylinders and stationary cam rings.

We claim:

1. A stamped knitting-tool which can be employed in knitting machines and has a head bent like a hook, a shaft having at least one bridge which consists of two guidepieces extending as far as the back of the knitting-needle and a stem arranged above the back to bridge across the guidepieces, and at least one butt coupled to the shaft in the region of the bridge, where the stem includes at least one first segment arranged between the head and the butt, said tool including means for controlling vibration within the needle and preventing tool breakage at increasing knitting speeds, said means including the shape of said needle which has said first segment (14, 23, 31,48) having a length of (l) of at least eight millimeters (8 mm) and a height (h) of at most eleven tenths of a millimeter (1.1 mm).

2. A knitting-tool as in claim 1, characterized in that at least one further butt (29, 42) is arranged in the region of at least one further bridge (36, 44) the stem (37, 51) of which has at least one first portion which is provided between the two butts (28, 29 or 41, 42 respectively) and has over a length of at least eight millimeters (8 mm) a height of at most eleven tenths of a millimeter (1.1 mm).

3. A knitting-tool as in claim 1, characterized in that the stem has a second segment (14, 49) which has over a length of at least eight millimeters (8 mm) a height of at most eleven tenths of a millimeter (1.1 mm) and is arranged at the side of the butt (12, 41) remote from the head (1).

4. A knitting-tool as in claim 1, characterized in that said bridge (7, 43) includes at least one further guidepiece (16, 47) extending as far as the back (10).

5. A knitting-tool as in claim 4, characterized in that the further guidepiece (16, 47) is arranged directly under the butt (12, 41) associated with said bridge (7, 43).

6. A knitting-tool as in claim 1, characterized in that the whole first segment (23, 31) is arranged between the head (1) and the butt (24, 28).

7. A knitting-tool as in claim 2, characterized in that the whole first portion of the stem (37, 51) of the further bridge (36, 44) is arranged between the two butts (28, 29 or 41, 42 respectively).

8. A knitting-tool as in claim 1, characterized in that said first segment (14) directly adjoins the butt (12) associated with the bridge (7).

9. A knitting-tool as in claim 1, characterized in that said first portion (31) directly adjoins the two guidepieces (30, 32) and the butt (28) adjoins the guidepiece (30) further removed from the head (1).

10. A knitting-tool as in claim 1, characterized in that said first segment (23, 31) borders on the butt (24, 30) via a part (25, 35) of the stem which has a greater height than said first segment (23, 31).

11. A knitting-tool as in claim 9, characterized in that said segment or respectively the stem (31, 56) borders on the guidepiece (30) via a part (35, 60) of the stem which has a greater height than eleven tenths of a millimeter.

12. A knitting-tool as in claim 1, characterized in that said first segment consists of a number of parts (57) spaced apart in the direction axial to the shaft and these parts (57) exhibit over a length measured in the direction axial to the shaft of altogether at least eight millimeters (8 mm) a height of at most eleven tenths of a millimeter (1.1 mm).

13. A knitting-tool as in claim 1, characterized in that the height of said segment (14, 15 or 48, 49 respectively) is less than one millimeter (1 mm).

14. A knitting-tool as in claim 12, characterized in that the height of said parts (57) is less than one millimeter (1 mm).

15. A knitting-tool as in claim 13, characterized in that the height of said segment (14, 15 or 48, 49 respectively) or respectively of its parts (57) amounts to nine tenths of a millimeter (0.9 mm).

16. A knitting-tool as in claim 14, characterized in that the height of said parts (57) amounts to nine tenths of a millimeter (0.9 mm).

17. A knitting-tool as in claim 1, characterized in that the whole stem (23, 31, 37, 51) has a length of at least eight millimeters (8 mm) and a height of at most eleven tenths of a millimeter (1.1 mm).

* * * * *

REEXAMINATION CERTIFICATE (1383rd)

United States Patent [19]

[11] B1 4,452,053

Egbers et al.

[45] Certificate Issued Nov. 13, 1990

[54] STAMPED KNITTING-TOOL FOR KNITTING MACHINES

[75] Inventors: Gerhard Egbers, Reutlingen; Bernhard Schuler, Sonnenbühl-Erpfingen; Adolf Seidel; Günter Bühler, both of Reutlingen, all of Fed. Rep. of Germany

[73] Assignee: Sulzer Morat GmbH, Filderstadt, Fed. Rep. of Germany

Reexamination Request:
No. 90/000,792, Jun. 3, 1985

Reexamination Certificate for:

| | |
|---|---|
| Patent No.: | 4,452,053 |
| Issued: | Jun. 5, 1984 |
| Appl. No.: | 291,934 |
| Filed: | Aug. 11, 1981 |

Related U.S. Application Data

[63] Continuation of Ser. No. 38,316, May 11, 1979.

[30] Foreign Application Priority Data

May 12, 1978 [DE] Fed. Rep. of Germany ..... 2820925

[51] Int. Cl.³ ..... D04B 35/02

[52] U.S. Cl. ..... 66/123

[58] Field of Search ..... 66/116, 121, 123, 120

[56] References Cited

U.S. PATENT DOCUMENTS

| | | | |
|---|---|---|---|
| 3,464,237 | 9/1969 | Kohorn | 66/121 |
| 3,712,082 | 1/1973 | Kohorn | 666/121 |
| 3,874,199 | 4/1975 | Mayer et al. | 66/121 |
| 3,994,145 | 11/1976 | Stolz | 66/121 X |
| 4,068,500 | 1/1978 | Kohorn | 66/123 |
| 4,089,192 | 5/1978 | Kohorn | 66/123 |

FOREIGN PATENT DOCUMENTS

| | | | |
|---|---|---|---|
| 1816864 | of 1971 | Fed. Rep. of Germany . | |
| 2157404 | of 1973 | Fed. Rep. of Germany . | |
| 2257847 | of 1973 | Fed. Rep. of Germany . | |
| 2304727 | of 1973 | Fed. Rep. of Germany . | |
| 2229858 | of 1974 | Fed. Rep. of Germany . | |
| 2238196 | of 1974 | Fed. Rep. of Germany . | |
| 2330474 | of 1974 | Fed. Rep. of Germany . | |
| 2408567 | 9/1975 | Fed. Rep. of Germany | 66/123 |
| 2537502 | of 1976 | Fed. Rep. of Germany . | |
| 2610078 | of 1977 | Fed. Rep. of Germany . | |
| 39-19263 | 6/1964 | Japan | 66/123 |
| 49-43152 | 11/1974 | Japan | 66/123 |

OTHER PUBLICATIONS

Torrington, "Latch Needle Handbook", Torrington Co. 1971, Torrington, Conn., pp. 8, 60, 61.

Knitted Outerwear Times, May 8, 1967.

Knitted Outerwear Times, Sep. 8, 1969.

Japanese Industrial Standard, Knitting Needle and Point, JIS L 1802-1957.

*Primary Examiner*—W. C. Reynolds

*Attorney, Agent, or Firm*—William R. Woodward; Stephen H. Frishauf

[57] ABSTRACT

A pivoted latch [needly] *needle* having stem segments or [budge] *bridge* portions of a height of eleven tenths of a millimeter and a length of at least eight millimeters.

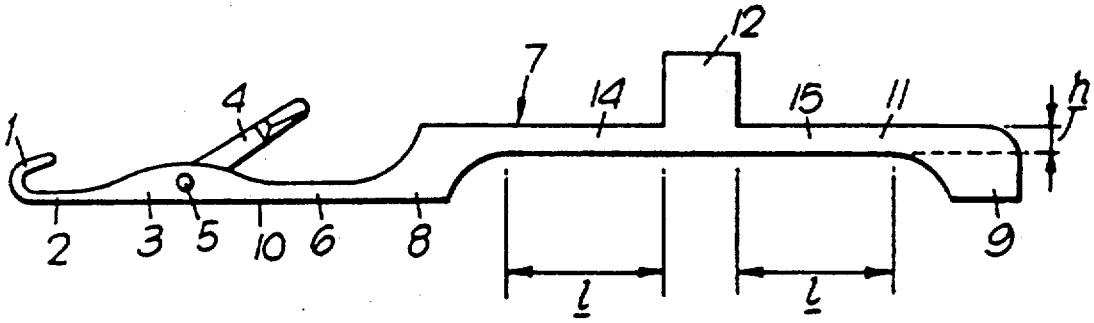

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 16–27:

Stamped knitting-tools of this kind are in particular latch needles (West German O/S No. 24 08 567), needles or components which indeed exhibit an end bent like a hook, i.e., the so-called head, but no latches, e.g., [plus] *plush* hooks for the formation of plush loops (West German Pat. No. 18 16 864), or parts carrying hooks, of tubular (compound) on pusher needles (West German O/S No. 25 37 502). All of these knitting-tools lie with their backs on the bottom of tricks each formed in the needle bed of a knitting machine and during the knitting process are moved to and fro at high speed and acceleration by means of cams which act upon their butts.

Column 2, lines 7–16:

Since none of the proposals indicated above has hitherto led to satisfactory and in particular adequately reproducible increases in knitting speed, it is an object of the invention to improve the knitting-tool designated above by simple means and in a reproducible manner. Another object of the invention is to provide a needle of the above kind, [wherein] *which* under comparable conditions may be moved to and fro at considerably higher speeds and accelerations without the number of head breakages during the test period altering worth mentioning.

Column 4, line 64–Column 5, line 5:

In the absence of the butt 29 the needle as *in* FIG. 4 has a shape similar to the needle as FIG. 1. A difference follows from the fact that for this case the part 38 on the one hand acts as a prolongation of the guidepiece 30 but on the other hand it may be conceived as a prolongation of the stem 37 or as a part of the stem which has a similar function to the part 35 of the stem. Consequently the guidepiece 38 may exhibit too the same dimensions as the part 35 of the stem and in particular be higher than eleven tenths of a millimeter.

Column 5, line 65–Column 6, line 2:

The knitting-tools in accordance with the invention are particularly suitable for flatbed knitting machines as well as for circular knitting machines of large diameter having rotatable cam rings and stationary needle cylinders or having rotatable needle cylinders and stationary cam rings.

AS A RESULT OF REEXAMINATION, IT HAS BEEN DETERMINED THAT:

Claims 1, 3, 4, 7 and 9 are determined to be patentable as amended.

Claims 2, 5, 6, 8 and 10 through 17 dependent on an amended claim, are determined to be patentable.

1. A stamped knitting-tool which can be employed in knitting machines and has a head bent like a hook, a shaft having at least one bridge which consists of two guidepieces extending as far as the back of the knitting-needle and a stem arranged above the back to bridge across the guidepieces, and at least one butt coupled to the shaft in the region of the bridge, where the stem includes at least one first segment arranged between the head and the butt, said tool including means for controlling vibration within the needle and preventing tool breakage at increasing knitting speeds, said means including the shape of said needle which has said first segment (14, 23, 31, 48) having a length [of] (l) of at least eight millimeters (8 mm) and a height (h) of at most eleven tenths of a millimeter (1.1 mm).

3. A knitting-tool as in claim 1, characterized in that the stem has a second segment ([14,] 49) which has over a length of at least eight millimeters (8 mm) a height of at most eleven tenths of a millimeter (1.1 mm) and is arranged at the side of the butt (12, 41) remote from the head (1).

4. A knitting-tool as in claim 1, characterized in that said bridge (7, 43) includes at least one further guidepiece (16, 47) extending as far as the back (10) *of the needle.*

7. A knitting-tool as in claim 2, characterized in that the whole first [portion] *segment* of the stem (37, 51) of the further bridge (36, 44) is arranged between the two butts (28, 29 or 41, 42 respectively).

9. A knitting-tool as in claim 1, characterized in that said first [portion] *segment* (31) [directly] adjoins the two guidepieces (30, 32) and the butt (28) adjoins the guidepiece (30) further removed from the head (1).

* * * * *